United States Patent [19]

Miller et al.

[11] Patent Number: 4,803,859

[45] Date of Patent: Feb. 14, 1989

[54] TUMBLER WHEEL STRUCTURE FOR RADIOLOGICAL DETECTOR RESISTANT COMBINATION LOCK

[76] Inventors: Harry C. Miller, 105 Bridle Ct., Nicholasville, Ky. 40356; Stephen Helesfai, 26 Vassar St., Rochester, N.Y. 14607

[21] Appl. No.: 152,892

[22] Filed: Feb. 5, 1988

Related U.S. Application Data

[62] Division of Ser. No. 1,221, Jan. 7, 1987.

[51] Int. Cl.[4] ..... E05B 15/14

[52] U.S. Cl. ..... 70/323; 70/333 R

[58] Field of Search ..... 70/323, 333 R, 303 R, 70/303 A, 324, 325, 326, 327, 328

[56] References Cited

U.S. PATENT DOCUMENTS

| | | | |
|---|---|---|---|
| 2,856,765 | 10/1958 | Sreb | 70/323 |
| 2,970,217 | 1/1961 | Enikeieff | 70/333 R |
| 3,024,640 | 3/1962 | Miller | 70/332 |
| 3,983,727 | 10/1976 | Todd | 70/323 |
| 4,040,280 | 8/1977 | Main | 70/333 R |
| 4,353,231 | 10/1982 | Uyeda | 70/323 |
| 4,693,100 | 9/1987 | Wetz | 70/316 |

*Primary Examiner*—Robert L. Wolfe

*Attorney, Agent, or Firm*—Mason, Fenwick & Lawrence

[57] ABSTRACT

A combination lock of the type adapted for changing of the combination by a change key, a lock case housing, a stack of a plurality of tumbler wheels loosely journaled on a tumbler post for rotation about its axis and each including an annular outer rim portion and an inner annular hub portion having teeth releasably intercoupling the hub portion and rim portion at any of a plurality of relative angular positions. The rim portions of the tumbler wheels have specially shaped peripheral gates to receive confronting portions of a fence on the fence lever when the tumbler wheels are properly aligned. The tumbler post is supported within the tumbler wheel hub portions for nonrotatable axial movement to shift the hub portions axially relative to the outer rim portions between coupled and decoupled relation. An actuator is activated by rotation of the change key for axially moving the tumbler post and the tumbler wheel hub portions to shift the hub portions to decoupled relation for combination change and a secondary change fence member is moveable into inserted relation in the tumbler wheel gates and retractable therefrom upon movement the of the actuator to selectively hold the rim portion against rotation.

1 Claim, 5 Drawing Sheets

32
52
60
61
59
59
61
61
59
62
62
38
62
39
48
50
65
67
65a
65b
57d
51f
57b
57c
53a
51e
51a
51
51g
22c
22b
22c
22
57a
54
57
56
21
40
21a
51d
23a
51d
21b
23

TUMBLER WHEEL STRUCTURE FOR RADIOLOGICAL DETECTOR RESISTANT COMBINATION LOCK

This application is a division, of application Ser. No. 1,221, filed Jan. 7, 1989 and now pending.

BACKGROUND AND OBJECTS OF THE INVENTION

The present invention relates in general to combination locks, and more particularly to combination locks especially deigned to resist compromise of security by detection of the opening combination of the lock through radiography or high energy radiation techniques.

Locks of the type commonly referred to as combination locks depend for their operation upon the alignment of a plurality of disc-like rotary elements, commonly called tumbler wheels, in a preselected manner to permit retraction of a reciprocative bolt from its projected position. Each tumbler is provided with a peripheral recess, commonly termed a gate, designed to receive a bar or fence normally disposed in overlying relation with the tumbler wheel peripheries and extending from a fence lever which is pivoted or otherwise coupled to a bolt and controls movement of the latter. When the tumbler gates are all disposed in registry with each other and in preselected alignment with the fence, and a driving cam which effects angular adjustment of the tumbler wheels through lost-motion connections and controls the fence lever is adjusted to a selected angular position, the fence may drop into the tumbler gates and permit such an interconnection of the fence lever with the driving cam that limited arcuate movement of the driving cam will impart movement to the fence lever to retract the bolt. The security of such locks is dependent upon the fact that the number of orders or permutations of the possible relative positions of the tumbler gates before all of the tumbler gates come into registry with the fence to permit retraction of the bolt is so large that the chance of these gates being aligned by a person not familiar with the combination is negligible.

In recent years, mechanical arrangements have been devised which are reasonably effective to protect the combination lock against mechanical manipulation thereof by unauthorized persons to surreptitiously detect the combination. However, various techniques have been developed in recent years for compromising the security of combination locks in safes and other security closures by the use of high-energy radiation. These have been variously termed radiography or radiological techniques and in general involve the production of pictures or other types of images of the lock works by photographing high-energy radiation which has passed through the lock mechanism, or by otherwise measuring such radiation emerging at various locations or for various positions of the pack of tumbler wheels. With the developments made in portable radiation sources, unauthorized persons may enter on the premises containing a security container and by radiological methods determine the combination setting of the lock and secure unauthorized entry to the protected enclosure in a short time without leaving any evidence of compromise of the lock combination.

Various arrangements have been devised in an effort to protect combination locks against compromise of the combination by such radiographic techniques, including particularly the provision of radiant energy scattering devices disposed within the lock housing, especially in surrounding relation to the tumbler wheels, to effect scattering of the penetrating radiation and thereby confound the image or photograph produced by radiological techniques. Examples of such radiant energy scattering devices may be found in earlier U.S. Pat. Nos. 2,970,217 and 3,024,640.

Other efforts to avoid detection by such radiographic image techniques attempting to permit observation of the angular locations of the tumbler wheel gates, with or without the presence of such radiation scattering devices, has been to form the tumbler wheels of low density materials such as nylon, rather than the metallic materials conventionally employed, to minimize the production of X-ray or high energy radiation shadows which would reveal the positions of the tumbler wheel gates.

In addition to use of X-ray photography techniques which provide a flat photograph of the wheel pack showing the positions of the gates, neutron beam gauging techniques or related high energy radiation measuring techniques have also been developed to reveal the combination of the lock. In the neutron beam gauging procedure, a neutron beam from an appropriate source is aimed at the edge of the tumbler wheel pack and the location of the gates is indicated on a counting device by a higher count for a set time period, which results from less metal, nylon or other material from which the tumbler wheel is made being in the beam path when the beam passes through a gate.

Some of the techniques developed to attempt to resist attack by such radiation detection procedures have included provision of additional false gates on each of the tumblers in addition to the true gate, to confound the radiological image, or the use of additional false tumbler wheels which indicate additional combination positions other than those for the true gates of the true tumbler wheels. Another technique developed is that disclosed in the Todd U.S. Pat. No. 3,983,727 of Oct. 5, 1976 assigned to the United States of America as represented by the Secretary of the Army, wherein a wheel pack is used in which a novel true-false gate system is provided on the perimeters of the tumbler wheels. The tumbler wheels are provided with a large number of gates about the periphery of each tumbler wheel, the gates being cut in the shape of right triangles and so positioned that the hypotenuse of the triangle on one side of each wheel intersects the hypotenuse of the triangle on the other side of the wheel, and only one of the gates on each wheel is a true gate. The contact portion of the fence associated with these tumbler wheels is designed to only contact one-half of each wheel and is shaped so that it will only fit into a gate whose shape and orientation is identical to the fence. Since all of the gates, whether true or false, have a mirror image gate immediately behind them, they all look the same in the X-ray image or the neutron counter measurement.

While combination locks with the Todd type tumbler wheel construction are effective in resisting radiological detection, the tumbler wheels disclosed in that patent are not of a construction suitable for effecting change of the lock combination. Obviously periodic changing of the combination of the lock by security personnel is a useful and important additional factor in deterring unauthorized opening of the combination lock.

An object of the present invention, therefore, is the provision of a novel combination lock with tumbler wheels having hub portions or wheel centers and rim portions or wheel cases, capable of being changed in their relative angular positions to each other circumferentially of each tumbler wheel to change the lock combination, and wherein the tumbler wheel gate arrangement provides true and false gates resistant to radiation detection, and the tumbler wheels are not provided with any change key holes in the wheel or gate configurations which could be detected radiographically.

Another object of the present invention is the provision of a novel radiographic detection resistant combination lock construction as described in the immediately preceding paragraph, wherein novel means are provided to effect axial movement of the wheel centers or hub portions of the tumbler wheels making up the wheel pack is effected by means which avoid the use of a change key which would require change key holes in the tumbler wheel centers or hub portions to resist radiographic detection of tumbler wheel position by detection of key change wheel openings.

Still another object of the present invention is the provision of such a combination lock construction wherein novel means are provided to restrain the tumbler wheel cases or rim portions against movement during combination change movement of the tumbler wheel centers or hub portions without revealing the position of the true gates of the tumbler wheels.

Another object of the present invention is the provision of a novel radiographic detection resistant combination lock as described in the preceding paragraphs, wherein a secondary or change fence is provided, in addition to the usual fence and fence lever, together with means for axially moving the wheel centers or hub portions of the tumbler wheels, wherein an actuator cam structure is provided to be rotated by a change key, associated with means which prevent change key movement of the actuator cam through a predetermined wheel hub disengaging range of movement when the previously existing proper opening combination has not been dialed, but which, if the correct combination has been dialed, permits tumbler wheel hub disengagement from the wheel cases during an active portion of actuator cam movement toward the end of the range of rotation of the change key.

Still another object of the present invention is the provision of a novel tumbler wheel structure wherein the wheel centers or hub portions of the tumbler wheels are capable of axial movement relative to the peripheries or case portions of the tumbler wheels and spring means are provided in the wheels coactive with shaped shoulder formations to cause the hub portions and wheel perimeters to snap apart and snap together for combination changing of the wheel in a hand change wheel assembly or during assembly of the lock having key change facilities.

Other objects, advantages and capabilities of the present invention will become apparent from the following detailed description, taken in conjunction with the accompanying drawings illustrating preferred embodiments of the invention.

DETAILED DESCRIPTION OF PREFERRED EMBODIMENTS

Figure 2:
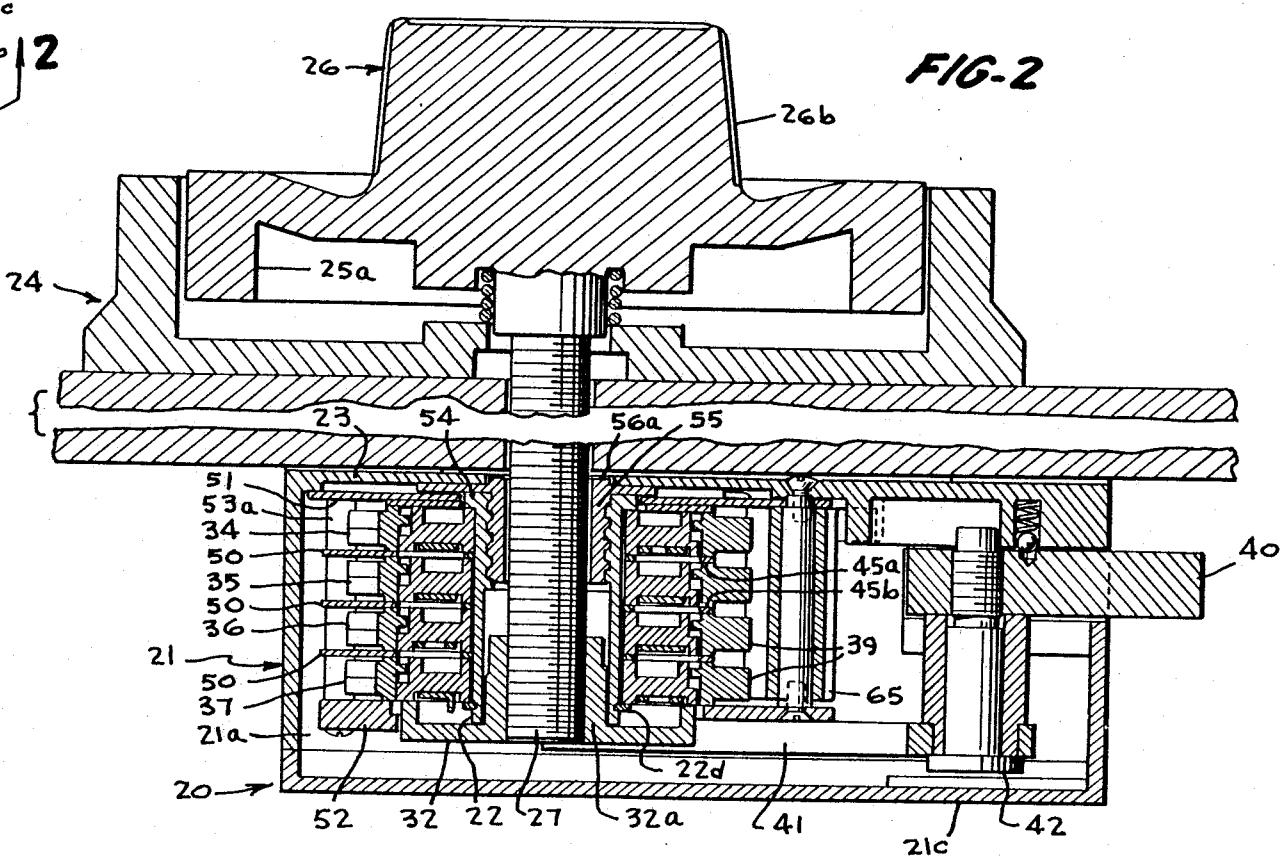
FIG. 2 is a horizontal longitudinal sectional view of the combination lock, taken along the line 2—2 of FIG. 1.
Figure 1:
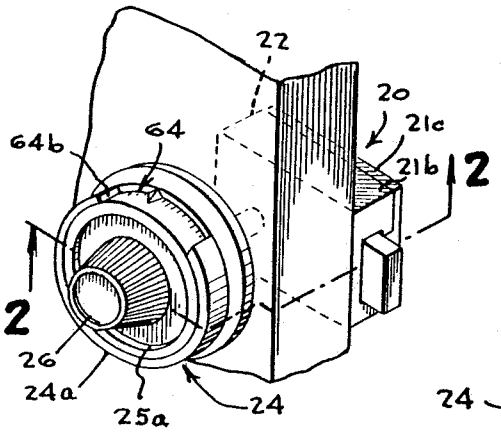
FIG. 1 is a perspective view of a combination lock constructed in accordance with the present invention.
Figure 3:
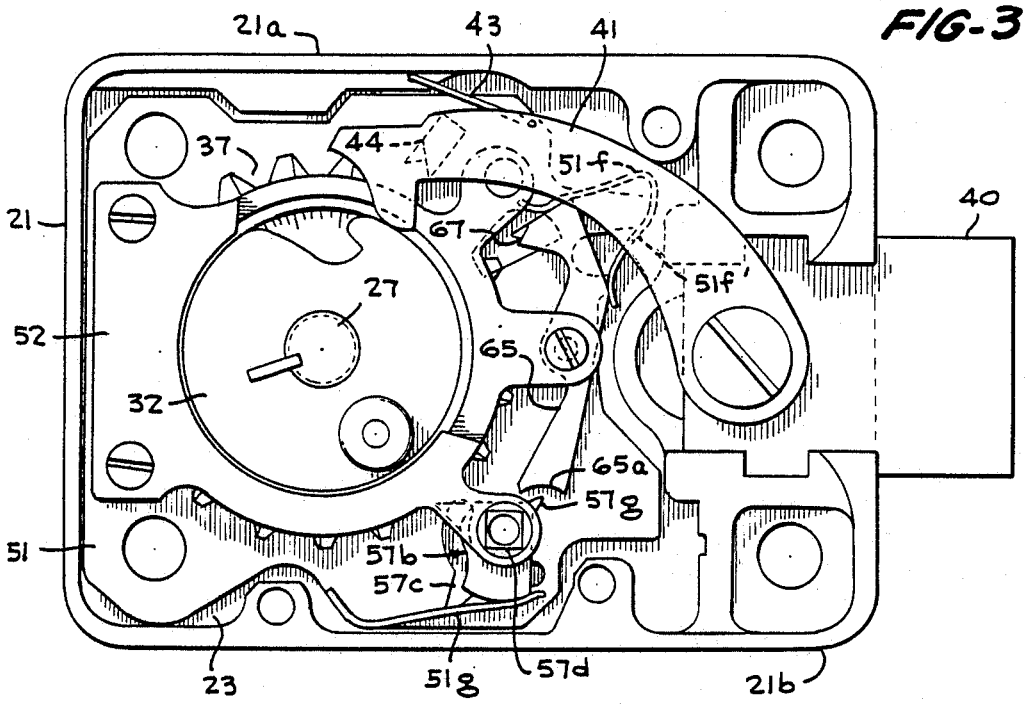
FIG. 3 is a rear elevation view of the combination lock with the rear cover removed, showing the lock in locked condition.
Figure 6:
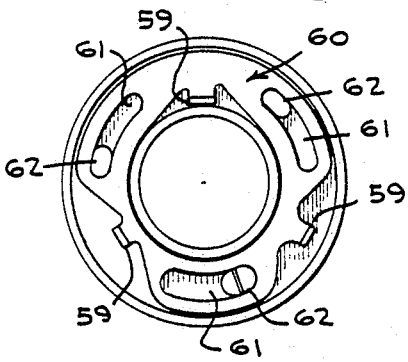
FIG. 6 is a rear elevational view of one of the tumbler wheel centers and an associated fly member.

Referring to the drawings, wherein like reference characters designate corresponding parts throughout the several figures, there is illustrated in FIGS. 1–11 a combination lock generally indicated by the reference character 20, which includes a substantially rectangular lock case 21 having top and bottom walls **21*a*, 21*b* and means rotatably supporting a hollow tubular tumbler post assembly 22, of special construction as hereinafter described, for rotary and axial movement, which projects rearwardly relative to the front wall 23 of the lock case. A removable rear cover plate 21*c* is provided to close the rear of the lock case. The lock case 21 is designed to be mounted against the inner surface of a safe door, file cabinet door or other security closure in the conventional manner as by mounting screws extending through screw holes near the corners of the lock case and into the supporting door, file cabinet front wall or the like. Secured to the outer face of the supporting door or mounting wall concentric with the axis of the tumbler post assembly 22 is a dial ring 24, here shown as having a cylindrical shield 24*a* surrounding and shielding from view the major portion of the peripheral flange 25*a* of the dial portion 25 of the dial and knob member 26, the shield 24*a* being interrupted by a sight opening 24*b*** of suitable circumferential extent.

The dial and knob member 26 is supported for rotation within the forwardly opening cylindrical well of the dial ring 24 defined by the shield 24*a*, and includes a drive spindle 27 coupled at its outermost end to the dial and knob member 26 and extending through the hollow tumbler post assembly 22 on the front wall of the lock case 21, to be rotatably journaled by the tumbler post assembly and supported at the desired position. The dial and knob member 26 has an integral knob portion 26*a* thereon which projects forwardly from the dial portion 26 and preferably has a knurled periphery to facilitate manipulation of the dial and knob member 26.

The threaded rearmost end of the drive spindle 27 receives an internally threaded portion of a tubular boss formation 32*a* projecting forwardly integrally from the driving cam 32. The driving cam 32 is keyed to the drive spindle 27 at the desired angular position by inserting a suitable spline key into the radial groove in the center bore of the drive cam which is aligned radially with a kerf in the spindle 27 to interlock these components against further relative rotation. A stack or array of a plurality of tumbler wheels, for example a four wheel stack or a three wheel stack, here shown as a four wheel stack, indicated by the reference characters 34, 35, 36 and 37, of special construction hereinafter described, are supported to rotate freely upon the cylindrical surface 22*a* of the hollow tumbler post assembly 22 extending rearwardly from the front wall of the lock case 21. It will be appreciated, of course, that a three tumbler wheel stack, or a stack of any other number of tumbler wheels may be used.

Each of the tumbler wheels 34, 35, 36 and 37 have an inner hub or wheel center portion 38 provided with a center opening 38*a* for journalling the tumbler wheel on the cylindrical post assembly 22 and have an outer rim or "wheel case" portion 39, which is interrelated in a special way with the wheel center or hub 38 of the associated tumbler wheel to permit combination change of the tumbler wheels in a novel way and resist radiographic detection.

The lock is also provided with the usual bolt 40 which is adapted to slide in a suitable guideway formed in one end of the lock case 21. The bolt 40 is operated by means o a fence lever 41 which is pivotly attached to the bolt by means of a screw 42. The fence lever 41 is normally resiliently urged to the elevated position illustrated in FIG. 3 by a lever spring such as the spring 43 having, for example, one end received in the fence lever 41 and another end inserted in a hole in a stationary portion of the lock casing to resiliently urge the fence lever to rotate to the raised position. The fence lever 41 is provided with a laterally projecting bar 44, commonly referred to a fence, which is of special configuration coactive with the configuration of the peripheries of the wheel case or rim portions 39, which projects along an axis parallel to the axis of the drive spindle 27 and overlies the peripheries of all of the tumbler wheels 34, 35, 36 and 37.

The outer wheel case or rim portions 39 of the tumbler wheels contain a specially shaped periphery defining a plurality of gates, only one of which is a true gate, in accordance with the principles disclosed in earlier U.S. Pat. No. 3,983,727 to Orin Todd, granted Oct. 5, 1976. Generally speaking, each wheel case or rim portion 39 includes an annular main body portion 45 having a shaped inwardly and outwardly directed faces 45*a*, 45*b* provided with tooth-like formations providing a plurality of gates, generally indicated at 46, extending circumferentially throughout the periphery of the wheel case with half of the gates on each wheel case or rim portion 39 being cut half way through one side of the wheel case and the other half of the gates being cut half way through the other side of the wheel case. All of the gate 46 are cut in the shape of a right triangle and are so positioned around the outer perimeter of each wheel case 39 that the hypotenuse of a triangle on one side of each wheel intersects the hypotenuse of a triangle on the other side of that wheel case.

Similarly, the fence 44 of the fence lever 41 which must drop into a gate on each wheel case 39 to permit opening of the lock by withdrawal of the lock bolt 40 is specially shaped with adjacent pairs of shaped triangular fence teeth, such as teeth 44-*a*, 44-*b*, arranged in immediately adjacent pairs and directed in oppositely inclined relations to interfit into the shaped gates 46 of the tumbler wheel case portions 39 so that they will only contact one-half of each wheel case 39 and will only fit into a gate identical in shape and orientation to the aligned fence tooth. There is only one gate on each wheel case that meets this requirement, and thus there is only one true gate on each wheel tumbler, while the rest of the gates form false gates. However, since all the gates, whether true or false, have a mirror image gate immediately behind them, they all look the same on a flat X-ray plate or to a neutron beam counter recording the strength of a gamma neutron source, so that it is not possible to distinguish the true gates from the false gates using X-ray or neutron gauging techniques.

Figure 5:
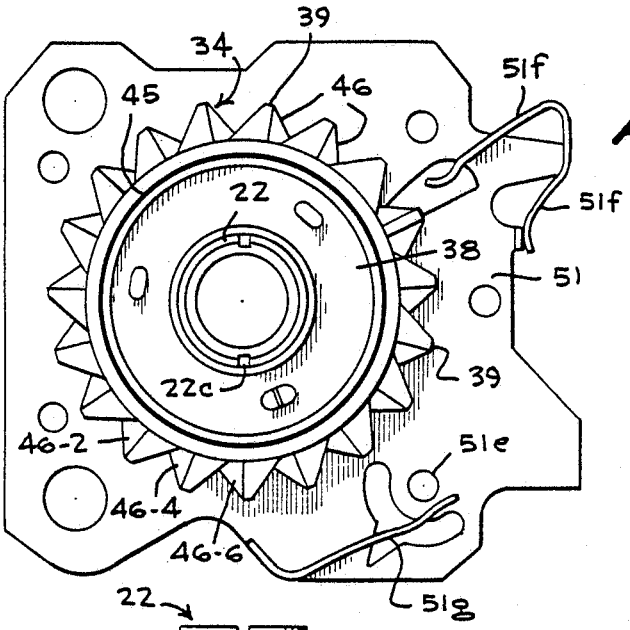
FIGS. 5 and 5A are top plan and elevation views respectively of a tumbler wheel of the tumbler wheel pack and bottom plate, with the actuator cam and change fence removed.
Figure 5A:
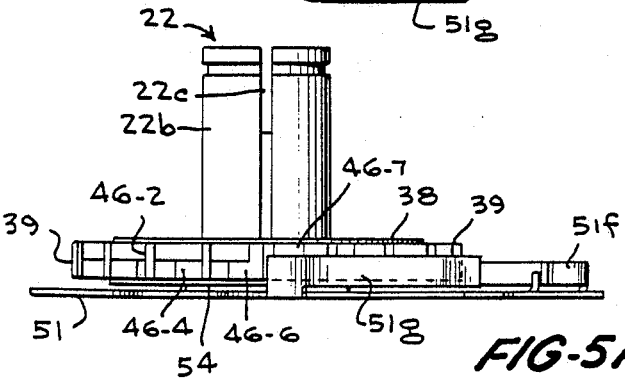
Figure 4:
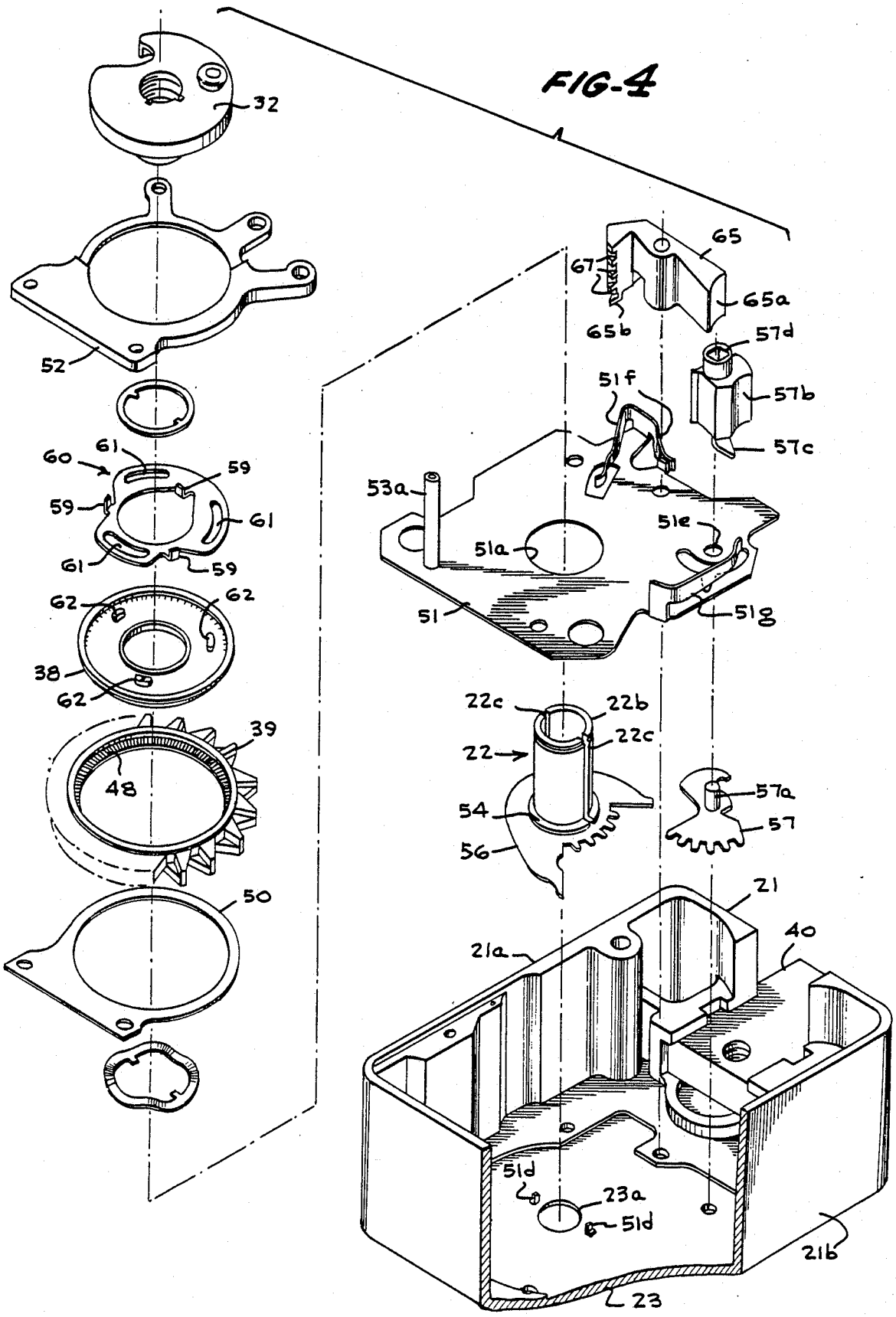
FIG. 4 is a perspective view, with part of the lock case shown in section of the support plates, and secondary fence, with the tumbler wheels and associated spacers removed.

More specifically, as shown in FIGS. 5A and 5A, the gates 46 are cut in the front and back half, in faces 45*a*, 46*b* of each wheel case or rim portion 39 and are so positioned relative to each other to form gate pairs 46-2, 46-3, or 46-4, 46-5, or 46-6, 46-7, as typical examples with the hypotenuse of the triangle of a gate on one side, for example 46-2, 46-4 or 46-6, intersecting the hypotenuse of the triangle of a gate on the other side, for example 46-3, 46-5, or 46-7. While the specific number of gates is not critical, it is obvious that the total number of gates will always be an even number since the gates in the back and front form gate pairs.

Only one of the gates 46 is a true gate, as the rest are false gates. The hypotenuse of the true gate goes from the edge of the wheel case 39 in an inwardly slanting direction whereas the hypotenuse of each of the other triangular gates 46-2, 46-4, and 46-6 for example, on the related side of the wheel case, going from the edge of the wheel case inwardly slant to the left. The hypotenuse of the triangle of each of the gates 46-3, 46-5, 46-7 and so on on the other side of the wheel case, for example, the rear side, all slant in the opposite direction from the hypotenuse of the triangle of gates 46-2, 46-4, 46-6, etc., and thus each of the gates has a mirror image gate behind it.

Figure 7A:
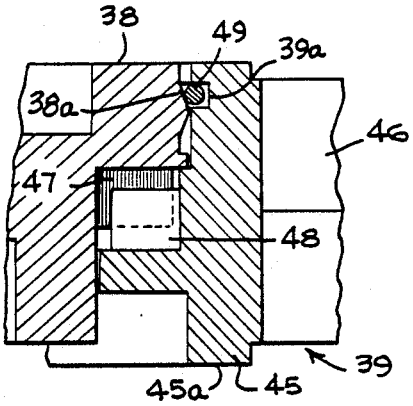
FIGS. 7A and 7B are enlarged fragmentary section views of adjacent portions of the tumbler wheel rim members and centers and the hub encircling spring associated therewith, shown in locked position and unlocked position respectively.
Figure 7B:
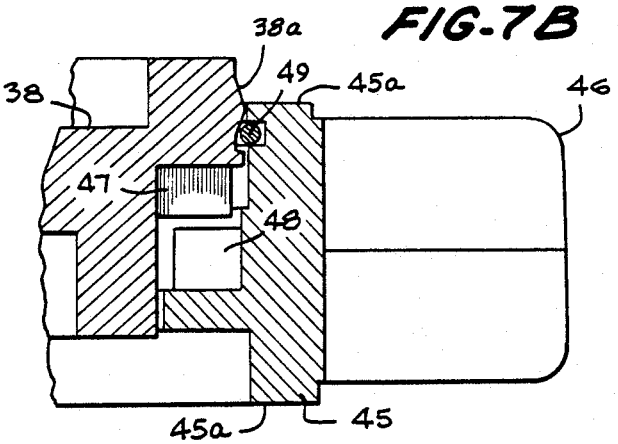
Figure 9:
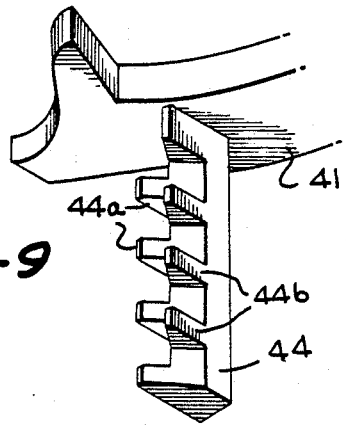
FIG. 9 is a fragmentary perspective view of the lower tooth formation portion of the primary fence on the fence lever.
Figure 8:
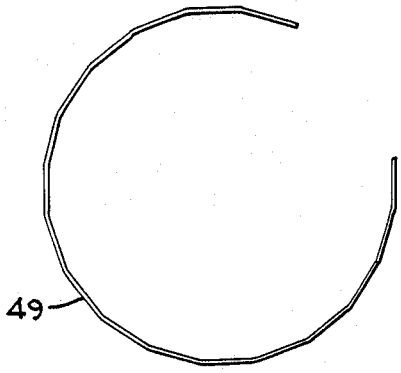
FIG. 8 :s a fragmentary elevational view of the spring of FIG. 7A.
Figure 10:
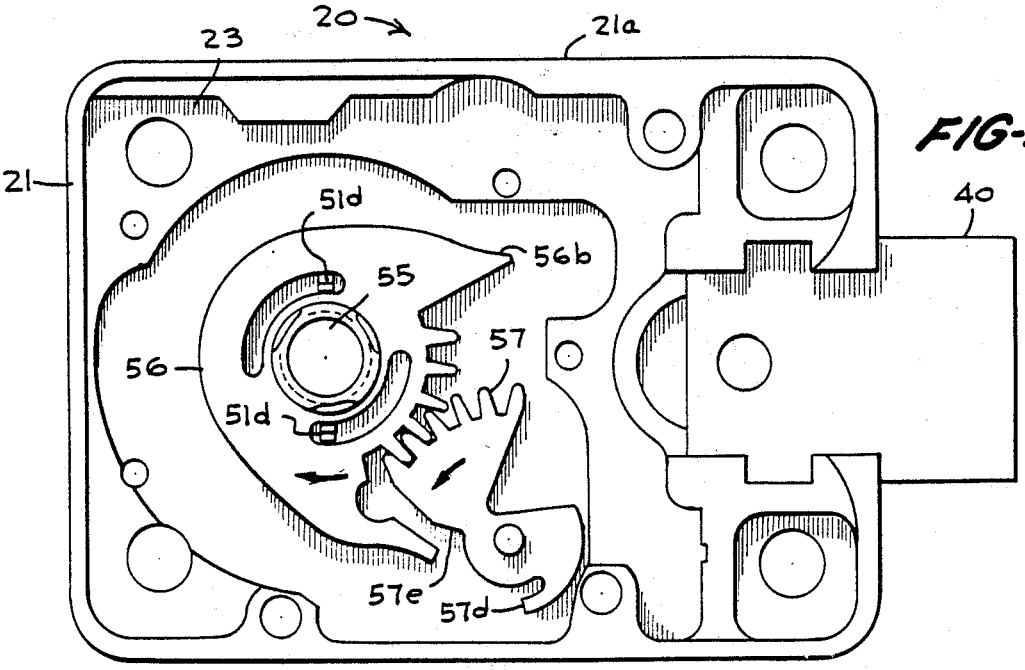
FIG. 10 is a diagrammatic rear elevational view showing the lift post member, the lift-post-moving gear member, and the sector gear member with the wheel pack, plates and other components removed to reveal these components.

The wheel case or rim portions 39 of the tumbler wheels 34, 35, 36 and 37 and the inner hub or wheel center portions 38 thereof are provided with interfitting teeth 47, 48 designed to interfit when the wheel and center portions 39, 38 are in the aligned or locked positions shown in FIG. 7A and to be disengaged when they are axially displaced relative to each other to the unlocked positions shown in FIG. 7B. The inner diameter or center opening surface of the wheel case members 39 are also provided with a retaining groove 39*a* designed to receive a spring wire 49 which forms a polygon with a large number of sides, a part of this spring wire retainer 49 remaining exposed outside the retaining groove 39*a* to allow for an interference fit with a ramp formation 38*a* on the wheel center members 38. This interference produced between the spring wire retainer 49 and the ramp formation 38*a* of the wheel centers 38 controls the ability of the wheel center 38 to move in or out with respect to the wheel case or rim portion 39. The wheel center portions 38 are moved by applying a force sufficient to elastically deform the spring wire retainer 49 upon movement of the tumbler post assembly 22 axially to shift the wheel centers from the FIG. 7A locked position to the FIG. 7B unlocked position when it is desired to change the combination of the lock. The shaping of the ramp formation 38*a* and its interaction with the spring wire retainer 49 are such as to produce a snap action arrangement whereby, when axial force in the proper direction is applied to the wheel center while the wheel rim or case portion is held against movement, the spring wire retainer 49 is progressively distorted radially outwardly until it reaches the crest of the ramp formation 38*a* and the energy stored in the spring then rapidly releases itself against the wheel hub or center portion to move it through the remainder of its allowed range of travel to the released position relative to its associated wheel rim or case portion. Similar snap action occurs during return of the wheel center or hub portion to the normal interlocked relation with its associated rim or case portion, which facilitates hand change of the combination of the tumbler wheel and retains the wheel center or hub portion and outer rim or case portion together as an assembly until forced sufficiently toward the released position, facilitating hand change of the wheel combination and assembly of the components in the lock mechanism assembly where key change features are provided.

The pack of tumbler wheels 34–37 are assembled together between bottom and top plate members 51, 52 and intervening spacers 50 fixed by spacer posts 53*a* fixed to the bottom plate 51 and mounting screws 53 threaded onto the front end wall 23 with the wheel case or rim portions 39 of the tumbler wheels 34–37 retained against axial movement by the wheel spacers 50, and by the bottom plate 51 and top plate 52, assembled together in a modular arrangement. The wheel spacers 50 are provided with center openings of slightly larger diameter than the tumbler wheel centers 38 to permit relative axial movement of the tumbler wheel centers 38 with respect to the tumbler wheel rim or case portions 39, while the spacers 50 and top and bottom plates 52, 51 restrain the wheel case or rim portions against axial movement. The spacer posts 53*a* and mounting screws 53 are located outwardly of the peripheries of the tumbler wheels 34–37 so that the tumbler wheels are free to rotate upon rotation of the dial and knob member 26.

The tumbler post assembly 22 provides the means for moving the wheel centers or hubs 38 axially in a direction to disengage their teeth 48 from the teeth 47 of the wheel rim or case portions 39, and comprises an axially moveable hollow tubular wheel post member 22*b* having a shoulder flange or collar 54 near its forward end adjacent the front wall 23 of the lock case forming a lift shoulder movable in the opening 51*a* of the bottom plate 51 between the nearest tumbler wheel 34 and a gear member 56 for axially moving the member 22*b* to move the flange or collar 54 against the confronting surface of the wheel center or hub portion 38 of the nearest tumbler wheel 34. The wheel post member 22*b* has an internally threaded bore portion which is threaded onto the threaded stub shaft portion 55 of a gear member 56 having a short forwardly projecting cylindrical tubular portion 56*a* journaled in the opening 23*a* in the front wall 23 of the lock case and extending through the bottom plate center opening 51*a*. The movable wheel post member 22*b* also includes a pair of diametrically opposite slots 22*c* to receive diametrically opposite lugs 51*d* projecting inwardly through the bottom plate opening 51*a* and slots 56*a* in gear member 56, restraining the post member 22*b* against rotation while allowing axial movement thereof as the gear member 56 is rotated.

The gear member 56 serves to axially move the wheel post member 22*b* by the threads on portion 56*a* interengaging threads on the inner surface of post 22 and is rotated by a change key sector gear 57 having a stub shaft 57*a* projecting into a hole 51*e* of the bottom plate 51 and into a socket in actuator cam member 57*b* to journal gear 57 for rotation. The sector gear 57 member is located below the bottom plate 51 adjacent its associated actuator cam member 57*b* which has a hollow opening 57*d* there through of square or other appropriate configuration to receive and be operated by a change key of typical non-round cross-section as later described, and is at a location spaced outwardly from the periphery of the tumbler wheels 34–37. Thus there is no change key opening in the tumbler wheels, such as are present in conventional combination locks, by which radiological images or measurement may be made identifying tumbler wheel change key openings signifying angular positions of the wheels. The actuator cam member 57*b* has a finger 57*c* moving in slot 51*e* of the bottom plate to selectively engage shoulder surfaces 57*d*, 57*e* of gear member 57 and includes a formation 57*g* coactive with part of a change fence 65 spaced radially outwardly of the tumbler wheels and pivoted to permit shifting of the fence 65 into and out of the true gates of the tumbler wheels at the change mode position. The change fence 65 and actuator cam member 57*b* are appropriately biased by spring formations 51*f* and 51*g* on the bottom plate 51 as later described.

Movement of the wheel center lift post member 22*b* and the engagement and disengagement of the wheel case and wheel center teeth 47, 48 is achieved by rotation of the change key gear sector member 57 through a suitable angle by finger 57*c* abutting shoulders 57*d* or 57*e*, causing rotation of the gear member 56 during a predetermined portion of the range of movement of cam 57*b*, rotating the male thread on portion 56*a* of the gear member 56, within the female threaded portion of the wheel center lifting post member 22*b*. This produces axial translation of the lifting post member 22*b* and its shoulder flange 54 rearwardly through the bottom plate opening, thus forcing the tumbler wheel centers 38, the forwardmost of which bears against the lift flange 54, axially rearwardly from the FIG. 7A position to the FIG. 7B position to disengage their teeth 47, 48 so that relative rotation of the wheel centers 38 relative to the tumbler wheel case or rim portions 39 can be achieved to effect combination change. The wheel centers 38 are returned forwardly to the normal interlocking relation with the rims 39 upon return of the post member 22*b* forwardly by rotation of gear member 56 as the washer 22*d* in a groove near the rearmost end of the post member 22*b* engages the rearmost tumbler wheel center and moves all the centers forwardly.

The tumbler wheels 34–37 are driven from the driving cam 32, spindle 27, and the dial and knob member 26 which operates the spindle 27, by means of a novel driving pin and fly arrangement, wherein the driving cam has three driving pins 58 arranged at three equal circumferentially spaced angles spaced different radial distances form the cam center, and engaging three rearwardly projecting lugs 59 projecting from a generally circular fly 60 seated in a rearwardly facing recess or well in the hub portion or wheel center 38 of the rearmost tumbler wheel 34 and similarly spaced different radial distances from the center axis of the wheel centers to be engaged by a different respective one of the drive pins. The fly 60, provides the usual lost motion coupling which is well known in tumbler wheel type combination locks by having arcuate recesses 61 at three equally spaced circumferential locations which receive similarly shaped, but circumferentially shorter arcuate projections 62 extending from the wheel centers 38 of the forwardly adjacent tumbler wheels and received in the recesses 61. A set of three forwardly projecting drive pin lugs 63 extend forwardly from the opposite face of each wheel center 39 to engage the fly lugs 59 of the fly 60 on the next forwardly adjacent tumbler wheels 35, 36 or 37 to achieve the usual lost motion coupling drive upon appropriate rotation of the driving cam 32. This fly arrangement, employing three drive projections or drive pins and three fly lugs to be engaged thereby, instead of the usual drive pin and single fly lug on the fly, is an improvement over the conventional single point drive providing for balanced forces, greater accuracy, and greater resistance to wear.

To effect changing of the combination, the existing opening combination is first dialed with respect to a combination change index reference, for example as indicated at 64, rather than the normal dialing reference index. The secondary or combination change fence 65, actuated by the actuator cam member **57*b* rotating the gear sector member 57, has teeth 67 similar to the teeth 44*a* or 44*b* of the normal dialing fence 44 to interfit with the true gates 46 defined by the right triangular tooth formations on the perimeters of the wheel case or rim portions 39 when the proper opening combination has been dialed with respect to the change index mark 64. Upon insertion of the change key through the change key opening 68 in the rear cover of the lock case, and through the non round opening in the actuator cam member 57*b*, rotation of the change key through about 90° rotates the actuator cam member 57*b* by driving engagement of the finger 57*c* with shoulder 57*d* of gear 57, if the proper combination was dialed, after the nose 57*g* engaged the lower end 65*a* of fence 65, to trip the change fence 65 and allow its spring 51*f'* to propel it radially inwardly to interengage its teeth 67 in the true gates of the tumbler wheel case or rim portions 39 during initial movement of the change key. During the remainder of movement of the change key, the change key gear sector member 57, rotated by finger 57*c*, drives the gear member 56 through an appropriate arc to cause the tubular lift post member 22*b* to move rearwardly sufficiently to force the wheel centers 38 rearwardly relative to the wheel case or rim portions 39 held by the wheel spacers and bottom and top plates 50, 51 and 52 and disengage the teeth 47, 48 of the wheel cases 39 and centers 38**.

The new or changed combination of the lock can then be dialed in the usual manner, causing the wheel centers 38 to be rotated to the new combination positions relative to their associated wheel cases 39 by the action of the driving cam 32 and its drive pin formations, and the flies 60 and associated lost motion coupling structure of the flies 60 and wheel centers 38, while the wheel case or rim portions 39 are held against rotation by the combination change fence 65. Upon completion of dialing of the new combination, the change key is then rotated back to its initial insertion position, causing rotation of the change key gear member 57 and gear member 56 to cause the tubular lift post member **22*b* to return to its normal position and, through engagement of the washer 22*d* with the rearmost tumbler wheel center 38 of tumbler 39, returning the wheel centers 38 forwardly relative to the wheel case or rim portions 39 to reengage their teeth 47, 48 and couple them in the new combination position. During the latter part of the rotation of the gear member 57 and its associated actuator cam member 57*b*, the shaped projection 56*b* engages the forwardly protecting lug 65*b* on the front side of the secondary change fence 65, pivoting the change fence 65** to its normal position withdrawing its teeth from the true gates of the tumbler wheels.

Once the combination has been set by the above described procedure, the combination lock is operated in the normal manner to open the lock in accordance with the new combination which has been set, by rotating the dial and knob member 26 first in one direction for more than four complete turns to bring the first number of the combination as indicated on the flange **25*a* of the dial portion 25 into alignment with the normal dialing stationary index mark on the dial ring 24, during which the three drive pins which are circumferentially spaced and of different radial spacings from the center of the drive cam 32 engage the fly drive lugs 59 associated with the rearmost tumbler wheel 34 and rotate that fly 60 through the lost motion arc permitted by the recesses 61 to then commence rotating the associated tumbler wheel 34. In similar fashion, through interaction of the driving pins 63 of wheel 34 with the fly drive lugs 59 associated with the next tumbler wheel 35, the tumbler wheel 35 is rotated and, through successive revolutions, rotation of the tumbler wheel 36 and then the tumbler wheel 37 is achieved to locate wheel 37 at its proper combination position. Rotation of the dial and knob member 26 in the opposite direction through more than three revolutions to the next combination position similarly effect positioning of the tumbler wheel 36, and rotation of the knob again in the opposite direction through more than two rotations effect adjustment of the tumbler wheel 35 to the proper position followed by final rotation of the dial again in the opposite direction to properly position the tumbler wheel 34. Upon return of the dial to the zero or opening position, the fence lever 41 is allowed to fall by registry of the gate of the driving cam with the nose of the fence lever, permitting the fence 44 to be lowered to a position inserting its tooth formations 44*a* into the properly aligned true gates on the rim portion of the tumbler wheels. Return rotation of the dial and knob member 26 in the opposite direction causes the fence lever nose to be cammed up out of the driving cam gate and projects the bolt 40 to the locking position. Further rotation of the dial and knob member through more than four revolutions insures scrambling of the tumbler wheels 34–37** to random nonaligned positions.

Figure 11A:
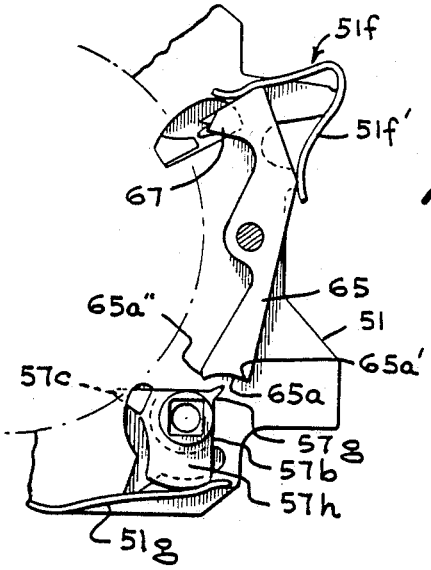
FIGS. 11A, 11B, and 11C somewhat diagrammatic, enlarged drawings of the actuator cam and adjacent portions of the secondary or change fence showing the same at normal locking and unlocking mode positions, at the position terminating movement of the actuator cam before completion of its stroke when the proper combination has not been dialed, and showing the parts in the combination change mode position, respectively.
Figure 11B:
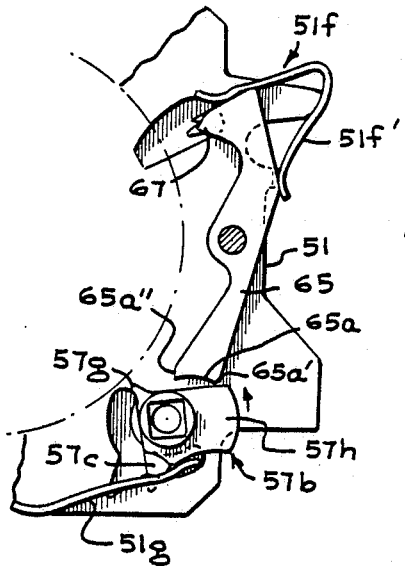
Figure 11C:
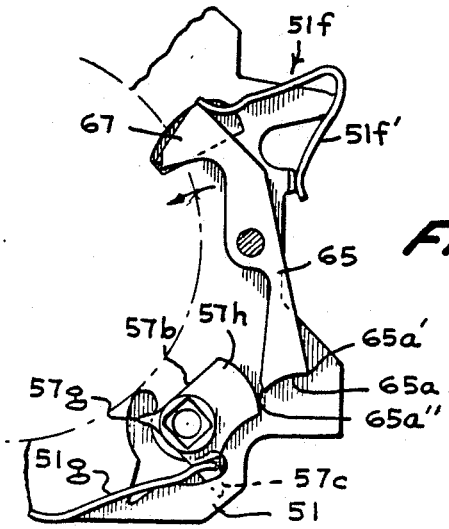

The action of the actuator cam member **57*b* in relation to the tail portion 65*a* of the secondary or change fence 65 is illustrated in FIGS. 11A, 11B, and 11C. FIG. 11A shows the parts in their normal relative position when the lock is in regular locking mode with the change fence 65 in its clockwise limit position wherein the teeth 67 thereof are spaced from and out of engagement with the peripheries 39 of the tumbler wheels. This is the relative position of the parts when the existing combination has been dialed preparatory to changing the combination of the lock. It will be noted that in this position, the nose formation 57***g* of the actuator cam member 57*b* is to the right of the proximal edge 65*a'* of the lower portion 65*a* of the secondary fence 65, and this proximal edge 65*a'* is in the path of movement of the formation 57*h* of the actuator cam 57*b* if one attempts to rotate the actuator cam 57*b* by means of a change key, when the secondary or change fence 65 has not been pivoted counterclockwise to interpose its teeth 67 in the true gates of the tumbler wheel peripheries. The actuator cam 57 is resiliently held in this position during regular operation of the lock by the leaf spring formation 51*g* formed from the bottom plate 51. If one attempts to place the lock in a combination change condition by inserting a change key in the opening 57*d* therefore in the actuator cam 57*b*, without manipulating the lock to the unlocked condition by dialing the combination so that the true gates of the tumbler wheels are positioned to receive the secondary or change fence teeth 67 therein, the tail formation 57*h* will be intercepted by the proximal corner or edge portion 65*a'* as illustrated in FIG. 11B, preventing further rotation of the change key and the actuator cam 57*b* through its full stroke. At the intermediate intercept position of the actuator cam 57*b* illustrated in FIG. 11B, the finger 57*c* of the actuator cam 57*b* has not yet contacted the abutment shoulder 57*d* of the driving sector gear 57 so that the sector gear is not rotated and thus no rotation of the gear member 57 has occurred. Thus no lifting of the tumbler post 22*b* and no axial displacement of the tumbler wheel center or hub portions has occurred at this FIG. 11B intercept position of the actuator cam 57*b*.

If, however, the proper combination is dialed and the change key is inserted to rotate the actuator cam member 57*b* counterclockwise from the FIG. 11A position, the nose formation 57*g* when it contacts the proximal edge or corner 65*a''* of the change fence 65 trips or cocks the change fence 65 through a short range of clockwise angular movement stressing the depending leg 51*f'* of its associated spring arm 51*f* and then releasing the change fence 65 as the nose formation 57*g* passes from under the lower edge thereof, permitting the energy in the spring leg 51*f'* to propel the upper end portion of the change fence 65 towards the tumbler peripheries and insert the teeth 67 thereof in the true gates of the tumbler wheels. The full range of actuator cam movement to the FIG. 11C position is thus permitted, during the latter portion of which the finger 57*c* contacts the abutment shoulder 57*d* and rotates the drive gear sector 57 through an appropriate arch to rotate the gear member 56 a sufficient amount to lift the tumbler post member 22*b* and the tumbler wheel center or hub portions moved therewith to the release position. The new lock combination is then dialed in the usual manner to set the tumbler wheel hubs or centers 38 at the proper angular positions for the new combination, and the change key and the actuator cam 57*b* rotated thereby are then rotated in a return direction back to the initial insertion position of the change key, disposing the actuator cam 57*b* in the FIG. 11A position. This return rotation of the change key and actuator cam 57*b*, and thus of the sector gear 57 when the finger 57*c* contacts abutment shoulder 57*e*, brings projection 56*b* against lug 65*b* of the change fence 65 to rotate fence 65 and shift its teeth 67 out of the true gates and swings the change fence 65 back to the initial, regular locking mode, position.

We claim:

1. Tumbler wheel for a plural tumbler wheel combination lock capable of manipulation to change the lock combination, comprising an annular outer rim portion and an inner annular hub portion, the outer rim portion of each tumbler wheel having a center opening having a diameter corresponding substantially to the outer diameter of the center hub portion, said center opening of the rim portion and the outer perimeter of said hub portion having confronting substantially cylindrical surfaces adapted to releasably abut each other with the rim and hub portions in coplanar alignment and interrupted by tooth formations on each of the hub and rim portions to interfit with each other restraining the associated hub and rim against relative rotation when in the coplanar normal operating position, the surface of the perimeter of each hub portion having a protruding ramp formation formed with a pair of inclined ramp surfaces converging to a crest, the ramp formation encircling the hub portion and the confronting portions of the center opening surface of the associated rim portion having a circular recess therein receiving a spring member encircling the confronting hub portion and distorted from circular configuration to project portions thereof from said recess into engagement with the confronting perimeter surface of the associated hub portion, the spring member engaging and being disposed adjacent one inclined surface of the protruding ramp formation when the hub and rim portions are in normal operating, coplanar interlocked position and being distorted by the ramp formation upon movement of the associated hub portion to combination change position displaced from the plane of the associated rim portion to engage an opposite inclined portion of the ramp formation and resiliently restrain the associated hub and rim portions in the combination change position to provide snap action relative movement of the hub portion to fully projected change position or to fully retracted coplanar interlocked position upon passage of the spring member over said crest.

* * * * *